US006471258B1

(12) United States Patent
Bombuy Perich

(10) Patent No.: US 6,471,258 B1
(45) Date of Patent: Oct. 29, 2002

(54) LATCHING MECHANISM OF AN ANTI-FINGER CATCHING SYSTEM

(76) Inventor: Marcelino Bombuy Perich, Pas d'an Marges, 32 Canet de Mar, Barcelona (ES)

( * ) Notice: Subject to any disclaimer, the term of this patent is extended or adjusted under 35 U.S.C. 154(b) by 0 days.

(21) Appl. No.: 09/400,528

(22) Filed: Sep. 21, 1999

(51) Int. Cl.[7] ..... E05C 1/12
(52) U.S. Cl. ..... 292/165; 292/169; 292/173
(58) Field of Search ..... 292/169, 165, 292/163, 123

(56) References Cited

U.S. PATENT DOCUMENTS

| | | | | | |
|---|---|---|---|---|---|
| 506,461 | A | * | 10/1893 | Beckwith | 292/169 X |
| 705,942 | A | * | 7/1902 | Markey | 292/169 X |
| 1,472,861 | A | * | 11/1923 | Adkins | 292/165 |
| 1,579,565 | A | * | 4/1926 | Osbeck | 292/169 X |
| 2,608,085 | A | * | 8/1952 | Castle | 292/169 X |

FOREIGN PATENT DOCUMENTS

| | | | | |
|---|---|---|---|---|
| EP | 0132842 | | 2/1985 | |
| EP | 0812975 | | 12/1997 | |
| FR | 613954 | * | 9/1926 | 292/165 |
| GB | 15126 | * | 7/1905 | 292/169 |
| GB | 265456 | * | 2/1927 | 292/169 |
| NL | 146014 | * | 6/1954 | 292/169 |

* cited by examiner

*Primary Examiner*—Teri Pham Luu
(74) *Attorney, Agent, or Firm*—Jacobson Holman PLLC

(57) ABSTRACT

An anti-finger-catching system in which elastic sections are fitted to the edges of the leaves of doors and windows, and optionally to the edges of their frames to prevent the user's fingers from being accidentally caught between the frame and the leaf The leaf has, on its front edge, a closing mechanism, fitted with a retractable bolt, whose rear part has a slot running along it through which a driver passes transversely, the driver being connected to operating knobs. The bolt also has an intermediate stop with a spring acting on it and tending to keep it in its protruding position; and a front part that is longer than the thickness of the elastic section.

18 Claims, 3 Drawing Sheets

LATCHING MECHANISM OF AN ANTI-FINGER CATCHING SYSTEM

THE SUBJECT MATTER OF THE INVENTION

This invention refers, as indicated by its title, to improvements made to the anti-finger-catching systems for doors and windows that involve fitting sections made of elastic materials to the edges of the frame and to the moving leaves that make up the door or window system in order to achieve elastic surfaces that prevent fingers from being injured in the event of their getting caught between the frame and the corresponding leaf.

PRIOR ART

Noteworthy in the prior art of the invention is Patent of Invention 9501740 by the same applicant, which describes an improved anti-finger-catching door-and-frame system. That system involves placing some strips or sections of rubber along the edges of the doors and their frames in such a way that if the moving leaf is unexpectedly closed and catches the hand or fingers of a user, the latter are not injured.

That invention also envisages the use of specially-designed hinges enabling the section to be fitted all the way along the frame and the door-leaf.

That invention proposes attaching the sections made of elastic material to the vertical edges of the door and to the frame as well, said sections being of a substantially prismatic, rectangular shape.

Though perfectly fulfilling its mission of preventing fingers from getting caught when the door closes unexpectedly, that system has certain drawbacks as regards the tightness of the closing and the fitting of a door-fastening mechanism to keep the leaf closed.

The problems for the fastening mechanism stem precisely from the larger distance that results between the facing edges of the frame and the leaf owing to the thickness of the elastic sections fitted on them.

At present, as a solution to this problem, the elastic sections are removed from the zones of the frame and the openable leaf that are used for mounting the fastening mechanism. For the fastening system to be able to fasten the leaf to the frame in the closed position, supplementary parts have to be added to the zones of the frame and leaf from which lengths of the flexible sections have been removed, the fastening mechanism then being mounted on those supplementary parts.

This solution is not satisfactory since there is still a risk of fingers getting caught by the bolt in the zone of the fastening mechanism.

European patent EP0132842 also describes a construction for the articulated connection of two pivoting door or window elements: it describes a hinge suitably adapted to leave sufficient distance between the back edges of the frame and the leaf to allow for fitting elastic sections that prevent fingers from being caught in that zone, i.e. in the hinged sides of the frame and leaf. However, this invention does not offer any solution for fitting elastic sections along the front sides of the door or window, i.e. in the sides that do not have hinges but that must have a mechanism enabling the leaf to be held closed.

DESCRIPTION OF THE INVENTION

The anti-finger-catching system for doors and windows that is the subject matter of this invention contributes special construction features whose purpose is to allow the fitting of elastic sections not only on the hinged sides of the leaf and frame but also on the opposite sides, a fastening mechanism having been devised for this that can be fitted on the moving leaf of the door or window without having to cut the elastic section fitted on the leaf, and without needing to attach any supplementary part of any kind on the leaf.

Furthermore, this fastening mechanism includes a retractable bolt designed to prevent fingers accidentally from being caught by the bolt.

The fastening mechanism of this invention includes a box casing that is fitted recessed in an opening made for the purpose in the moving leaf, and a bolt which can move longitudinally in the box.

The bolt has a rear portion that is housed inside the box, an intermediate stop, and a front portion whose length is greater than the thickness of the elastic section fitted on the front edge of the leaf. This feature allows the front portion of the bolt to reach its closed position regardless of whether it is a latch bolt for sliding doors or whether it is a running bolt for hinged leaves.

The bolt of this invention has, in its rear portion, a longitudinal slot allowing the passage of a transversal driver connect to the handles or knobs used for operating the fastening mechanism.

This slot enables the bolt to be moved longitudinally towards the rear zone of the box when its front end is pushed inwards.

Thus, in the event of the front end of the bolt coming into contact accidentally with the fingers or hand of a user resting his fingers or hand on the frame, the bolt would automatically recede, no harm arising for the user.

To allow the bolt to recede, an opening of sufficient size to allow it to pass through is provided at the back of the box of the fastening mechanism.

A spring is fitted inside the box which acts on the back of the box and on the intermediate stop of the bolt, tending to keep the bolt in its forward position in which the driver attached to the knob for operating the fastening mechanism makes contact with the rear end of the bolt's slot, thus enabling the bolt to recede sufficiently far back to pass from a closed to an open position when the driver is moved by the use of one of the knobs.

To achieve optimum operation of this fastening mechanism, the frame in the zone opposite the fastening mechanism mounted on the leaf is to have a supplementary piece with the opening for receiving the bolt. This supplement is of a thickness that is substantially equal to the thickness of the elastic section fitted on the frame. In order to eliminate that elastic section entirely, which would leave said supplementary piece exposed, the elastic section has an opening in its rear wall in the zone facing the supplementary piece, the opening being of a shape that is analogous to the shape of the supplementary piece, and there being an opening in the front wall of sufficient size to allow the bolt to go through. Hence the supplementary piece is recessed in the elastic section joined to the frame, and it is protected by that section.

DESCRIPTION OF THE DRAWINGS

A set of drawings is provided as an integral part of this patent description, they being for the purposes of illustrating the subject but not limiting it, providing a complement for the description given here to aid with understanding it.

PREFERENTIAL EMBODIMENT OF THE INVENTION

Figure 1:
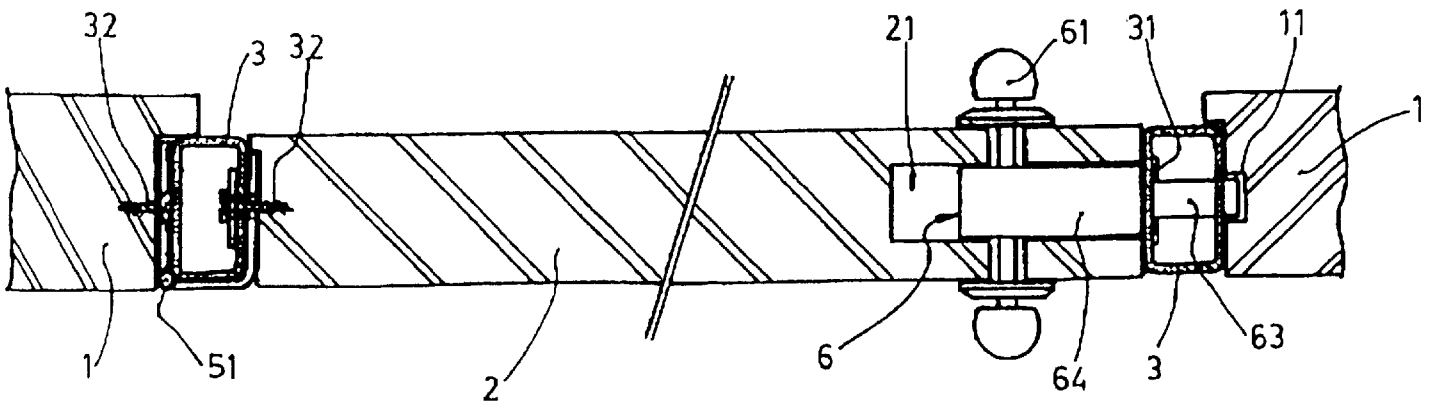
FIG. 1 shows a plan view of a fastener for a hinged leaf in horizontal cross-section form, in which only the opening leaf is fitted with an elastic section along the edges facing the frame.

As can be seen in those figures, the anti-finger-catching system of this invention is applicable to doors and windows that have a frame (1) around them, to which a moving leaf (2) is attached, in hinged or sliding form As can be seen in FIG. 1, elastic sections (3) are fitted on the leaf (2), one on front edge and one on the back edge, by means of screws (32) driven into inner bushings (31).

Figure 2:
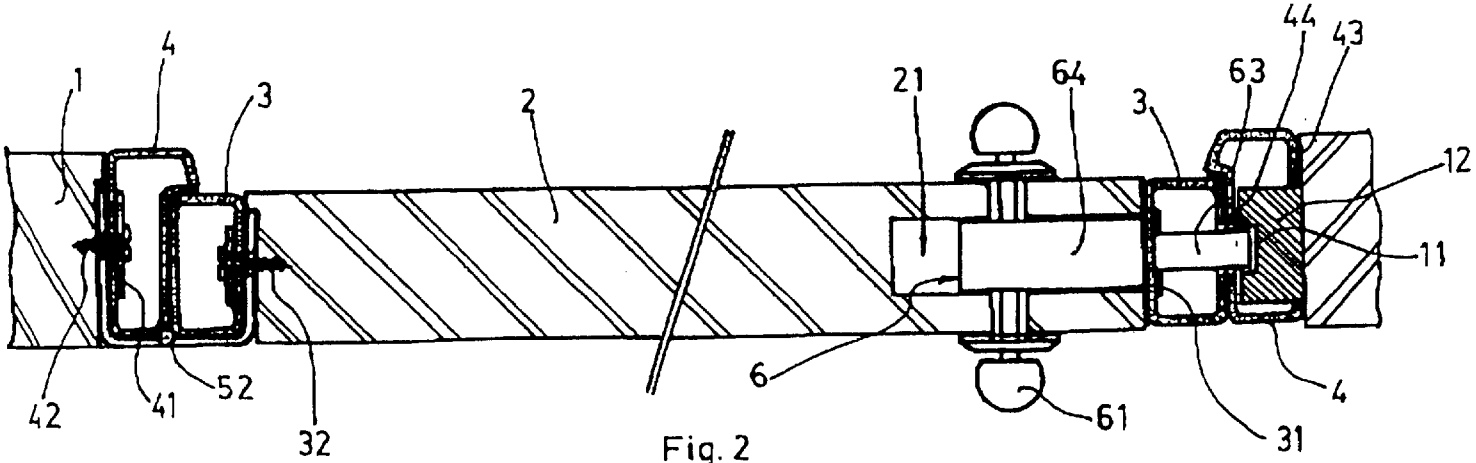
FIG. 2 shows a view, similar to the previous one, in which both the frame and the opening leaf are fitted with flexible sections on their facing edges.
Figure 3:
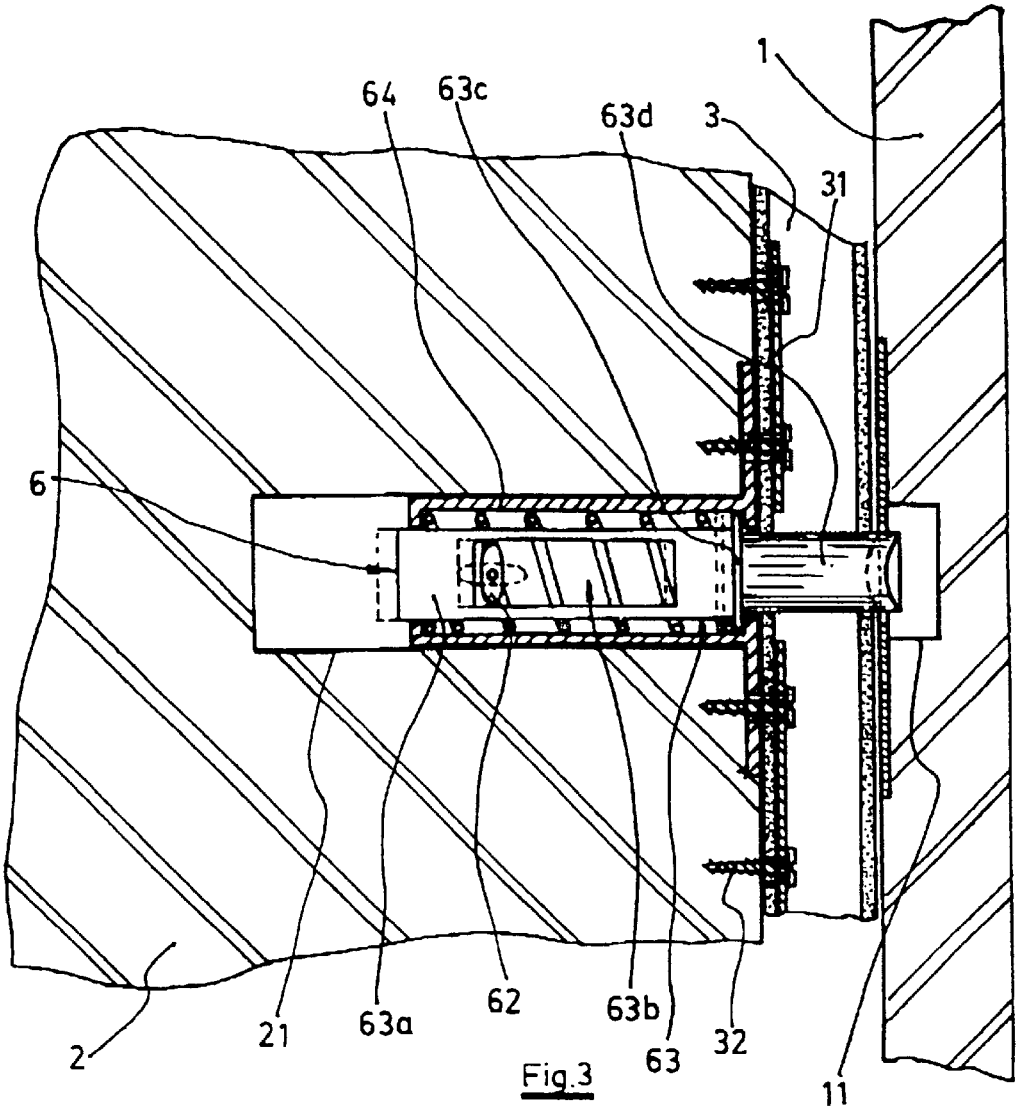
FIG. 3 shows an elevation view of a portion of the fastener in vertical cross-section form, in which the fastening mechanism for hinged leaves can be seen. In this figure, the driver and the bolt are drawn with solid lines for the closed position and dotted lines for the open position.

Optionally, as shown in the embodiment given as an example in FIG. 2, the frame (1) can also have an elastic section (4) on the edges that face the leaf (2) which comes up against the elastic section (3), partially overlapping it, when the leaf (2) is closed.

The elastic section (4) is attached to the frame (1) by means of bushings (41) and screws (42) similar to those used for attaching the other section (3).

In the case of hinged leafs, these are attached to the pertinent edge of the frame (1) by means of hinges (51 and 52) that are shaped to reach over the space occupied by the section (3) or the sections (3 and 4) respectively.

Regardless of whether the leaf (2) is hinged or sliding, it will have an elastic section (3) on its front edge similar to those mentioned above. The purpose of the elastic sections (3 and 4) is to prevent the fingers or hands of users being injured in the event of the leaf (2) trapping them against the frame (1) if the leaf shuts unexpectedly.

The leaf (2) has a closing mechanism (6) on its front edge designed to keep the leaf (2) in its closed position with respect to the frame (1), and to prevent fingers becoming trapped between it and the frame (1).

As can be seen in FIGS. 1, 2, 3 and 4, the closing mechanism (6) includes knobs (61) that act on a driver (62) whose mission is to drive a bolt (63) between its closed position and its open position.

The bolt (63) is fitted so as to be able to travel longitudinally inside a box (64) which is recessed in an opening (21) made for the purpose in the front edge of the leaf (2).

The bolt (63) has a rear portion (63*a*) with a longitudinal slot (63*b*) along which the driver (62) travels, an intermediate stop (63*c*), and a front portion (63*d*) that is longer than the elastic section (3) fitted on the front edge of the leaf (2).

There is a spring (65) inside the box (64) that acts on the rear end of the box (64) and on the intermediate stop (63*c*), tending to keep the bolt (63) in a protruding position.

Figure 4:
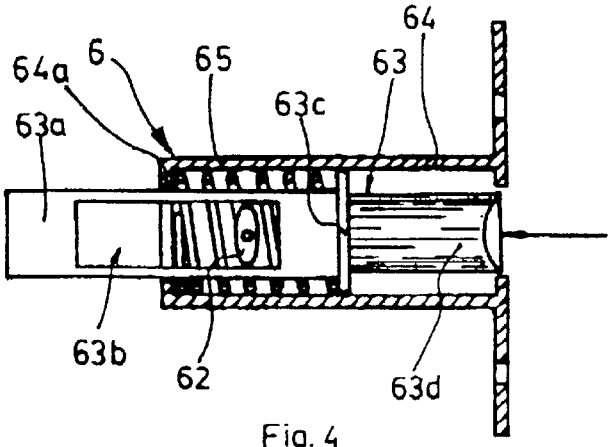
FIG. 4 shows an elevation view of the fastening mechanism, shown in the previous figure, in which the bolt has moved backwards in response to pressure on its front end.

The box (64) has an opening (64*a*) at the rear end which, together with the longitudinal slot (63*b*), allows the bolt (63) to recede when pushed from the front, as shown in FIG. 4.

The bolt (63) tends to remain in contact, through the rear end of the slot (63*b*), with the driver (62), the latter being shaped so as to recede by a certain amount, its front end clearing the opening (11) of the frame (1) when the driver (62) is turned by the use of either of the knobs (61).

Figure 5:
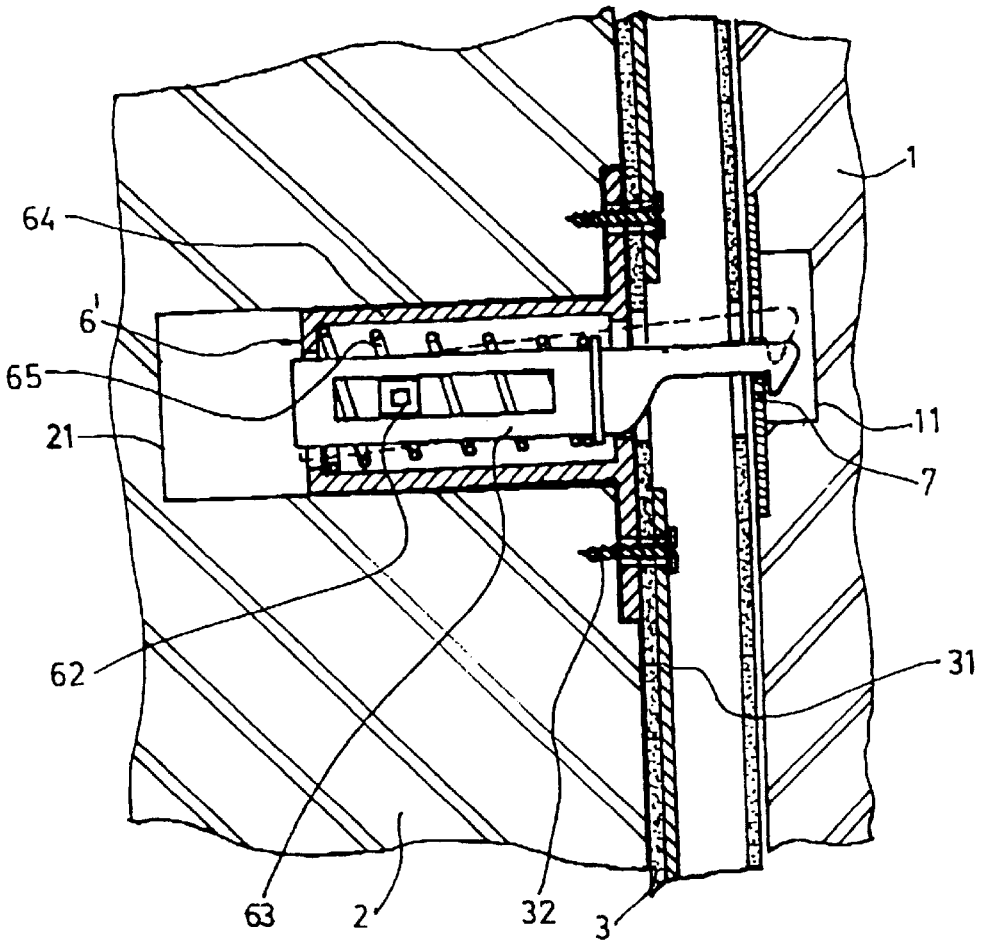
FIG. 5 shows a partial elevation view of a fastening system for a sliding leaf in which the fastening mechanism can be seen, it having a latch-bolt in this case. In this figure, the bolt and its driver are drawn in solid lines for the closed position and with dotted lines for the open position.
Figure 6:
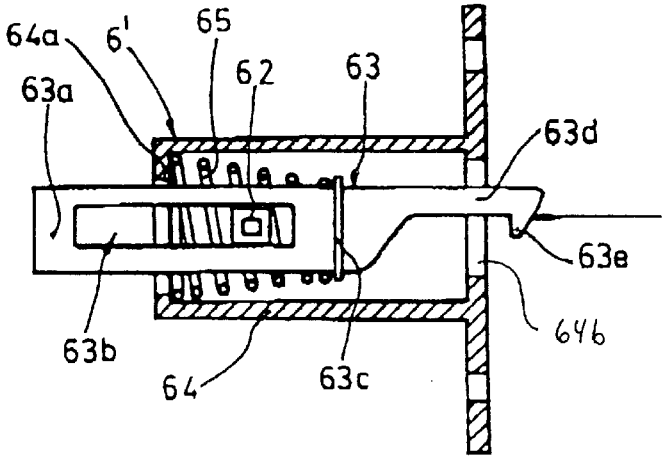
FIG. 6 shows an elevation view of the fastening mechanism, as in the previous figure, in which the bolt can be seen pushed back through pressure on its front end.

If the leaf is a sliding leaf, as shown in FIGS. 5 and 6, the design of the closing mechanism (6') is similar to the previous closing mechanism (6), having a latch bolt (63) which has a tooth (63*e*) that couples with a secure element (7) joined to the frame (1) and facing the hole (11).

In this case, the driver (62) will be so shaped as to allow said bolt (63) to move vertically when driven by one of the knobs (61). The box (64) also has a mouth (64*b*) that is large enough to allow for the moving of that bolt (63).

If the frame (1) has an elastic section (4), as shown in FIG. 2, then a supplementary piece (12) is fitted where that section meets the closing mechanism, the supplementary piece (12) being slightly less thick than the section (4), and having an opening (11) on its front to take the bolt.

In this case the section (4) will have an opening (43) on its rear wall to allow fitting over the supplementary piece (12), and a smaller opening (44) in its front wall to allow access for the front portion (63*d*) of the bolt to the opening (11), the supplementary piece (12) remaining concealed inside the section (4).

No further enlargement of this description is deemed necessary for an expert in the subject to understand the scope of the invention and the advantages it brings.

The materials, form, size and layout of the elements may be altered provided that the essential characteristics of the invention as claimed hereunder are not thereby altered.

I claim:

1. An anti-finger catching system for doors and windows, said anti-finger catching mechanism comprising:

a frame, a moveable leaf attached to the frame and the moveable leaf having, on front and rear edges, elastic sections for preventing a user's fingers from being accidentally trapped between the frame and the moveable leaf, a closing mechanism of the moveable leaf being fitted with a retractable bolt acting against the frame for holding the leaf in a closed position and said closing mechanism being retractable upon contacting the user's fingers for preventing the user's fingers from being trapped between the frame and the closing mechanism of the moveable leaf;

said bolt having a rear portion with an elongated longitudinal slot through which a driver passes transversely, said driver being linked to operating knobs, and a section of the bolt located between an intermediate stop and a front portion of the bolt being longer than the elastic section mounted on the front edge of the moveable leaf so that the section of the bolt can extend through the elastic section mounted on the front edge of the leaf and engage the frame with the section of the bolt being fully retractable into the leaf by movement of the driver in the elongated longitudinal slot upon contacting fingers between the frame and the leaf.

2. An anti-finger catching system as in claim 1, wherein the bolt is fitted to move longitudinally in a box casing recessed in the front edge of the leaf.

3. An anti-finger catching system as in claim 2, wherein a spring housed inside the box casing acts on and extends between a rear end of the box casing and on the intermediate stop to keep the bolt in a protruding position.

4. An anti-finger catching system as in claim 3, wherein the bolt, in the protruding position, causes contact between a rear portion of the slot and the driver.

5. An anti-finger catching system as in claim 4, wherein the box casing has an opening at a rear end which, together with the longitudinal slot, allows the bolt to recede with respect to the box casing.

6. An anti-finger catching system as in claim 5, wherein the driver makes the bolt move from a closed to an open position when one of the knobs is moved.

7. An anti-finger catching system as in claim 1, wherein the frame has an opening for receiving a front end of the bolt in a zone facing the closing mechanism.

8. An anti-finger catching system as in claim 1, wherein the frame and the moveable leaf each have an elastic section along facing edges, and the frame has a supplementary piece located adjacent to the closing mechanism on the moveable leaf, the supporting piece being slightly less thick than the elastic section, and having an opening on a front portion to receive the bolt.

9. An anti-finger catching system as in claim 8, wherein the elastic section has an opening on a rear wall to allow fitting over the supplementary piece, and a smaller opening in a front wall to allow access for the front portion of the bolt to extend through the smaller opening, the supplementary piece remaining concealed inside the elastic section.

10. A latching mechanism of an anti-finger catching system for doors and windows having a frame and a moveable leaf having an elastic section on a front edge, said latching mechanism comprising:

a box casing for being recessed in the front edge of the moveable leaf, a retractable bolt having a rear portion with an elongated longitudinal slot that allows sliding of an associated driver, the driver being linked to operating knobs, and a section of the bolt between an intermediate stop and a front portion of the bolt being of a predetermined length for extending through the elastic section mounted on the front edge of the leaf, and a spring housed inside the box casing acting on a rear end of the box casing and on the intermediate stop to keep the section of the bolt in a protruding position and for allowing retraction of the section of the bolt into the leaf by sliding of the driver in the elongated longitudinal slot when the bolt engages a user's fingers located between the bolt and the frame.

11. A latching means as in claim 10, wherein the bolt, in the protruding position, causes contact between a rear portion of the slot and the driver.

12. A latching means as in claim 10, wherein the box casing has an opening at a rear end which, together with the longitudinal slot, allows the bolt to recede with respect to the box casing.

13. A latching means as in claim 10, wherein the driver makes the bolt move from a closed to an open position when one of the knobs is moved.

14. An anti-finger catching system for doors and windows, said anti-finger catching system comprising:

a frame, a moveable leaf having an elastic section on a front edge, and a closing mechanism including a box casing recessed in the front edge of the leaf, a retractable bolt having a rear portion with an elongated longitudinal slot that allows sliding of an associated driver, the driver being linked to operating knobs, and a section of the bolt located between an intermediate stop and a front portion of the bolt being longer than the elastic section mounted on the front edge of the moveable leaf so that the section of the bolt can extend through the elastic section and engage the frame, and a spring housed inside the box casing acting on a rear end of the box casing and on the intermediate stop to keep the bolt in a protruding position and for allowing full retraction of the bolt by movement of the driver in the elongated longitudinal slot when the bolt engages a users fingers located between the bolt and the frame.

15. An anti-finger catching system as in claim 14, wherein the bolt, in the protruding position, causes contact between a rear portion of the slot and the driver.

16. An anti-finger catching system as in claim 14, wherein the box casing has an opening at a rear end which, together with the longitudinal slot, allows the bolt to recede with respect to the box casing.

17. An anti-finger catching system as in claim 14, wherein the driver makes the bolt move from a closed to an open position when one of the knobs is moved.

18. An anti-finger catching system as in claim 14, wherein the frame has an opening for receiving a front end of the bolt in a zone facing the closing mechanism.

* * * * *